United States Patent [19]

Iwahara et al.

[11] 4,118,599

[45] Oct. 3, 1978

[54] STEREOPHONIC SOUND REPRODUCTION SYSTEM

[75] Inventors: Makoto Iwahara; Toshinori Mori, both of Yokohama, Japan

[73] Assignee: Victor Company of Japan, Limited, Japan

[21] Appl. No.: 772,149

[22] Filed: Feb. 25, 1977

[30] Foreign Application Priority Data

| | | | |
|---|---|---|---|
| Feb. 27, 1976 | [JP] | Japan | 51-20098 |
| Mar. 14, 1976 | [JP] | Japan | 51-27313 |
| Mar. 14, 1976 | [JP] | Japan | 51-27314 |

[51] Int. Cl.[2] ..... H04R 5/00

[52] U.S. Cl. ..... 179/1 G; 179/1 GP; 179/1 GQ

[58] Field of Search ..... 179/1 G, 1 GP, 1 GQ, 179/100.1 TD, 100.4 ST

[56] References Cited

U.S. PATENT DOCUMENTS

| | | | |
|---|---|---|---|
| 3,088,997 | 5/1963 | Bauer | 179/1 G |
| 3,236,949 | 2/1966 | Atal et al. | 179/1 G |
| 3,238,304 | 3/1966 | Yaita et al. | 179/1 G |
| 3,710,023 | 1/1973 | Greuzard et al. | 179/1 G |
| 3,892,624 | 7/1975 | Shimada | 179/1 G |

FOREIGN PATENT DOCUMENTS

| | | | |
|---|---|---|---|
| 2,406,712 | 8/1975 | Fed. Rep. of Germany | 179/1 G |

*Primary Examiner*—Douglas W. Olms

*Attorney, Agent, or Firm*—Robert E. Burns; Emmanuel J. Lobato; Bruce L. Adams

[57] ABSTRACT

A stereophonic sound reproduction system comprises a first signal converter receptive of an audio signal for converting it into a binaural signal containing information as to the localization of the original sound source at a desired location in a listening area, and a second signal converter for converting the binaural signal into a signal containing no acoustic components which would produce the effect of crosstalk between listener's ears when the signal is reproduced in the listening area. A sound field expansion system is also disclosed which includes a converter which processes an input signal for generating an acoustic signal which localizes virtual sound sources so that the listener is given the impression of an expanded listening area.

13 Claims, 22 Drawing Figures

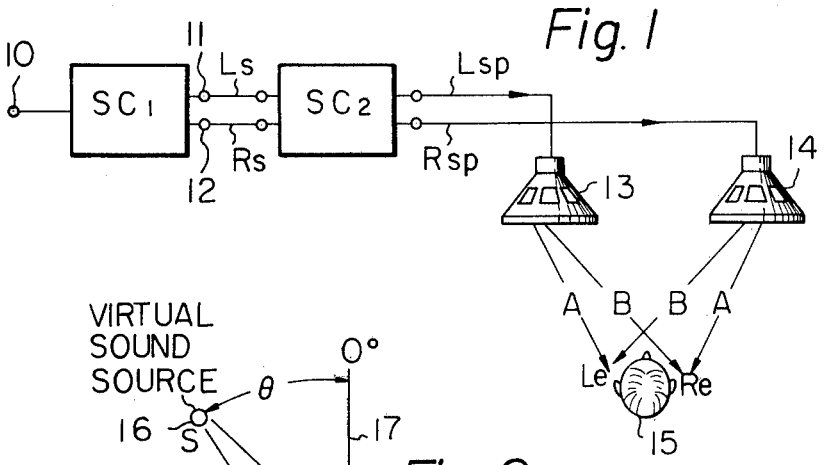
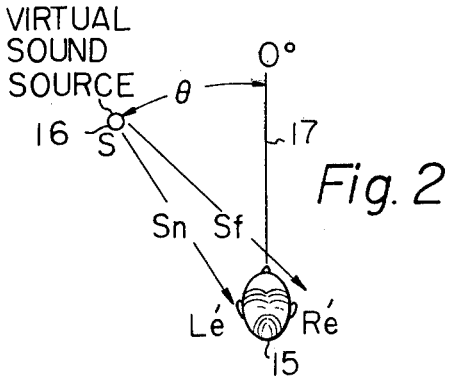
Fig. 2
Fig. 9
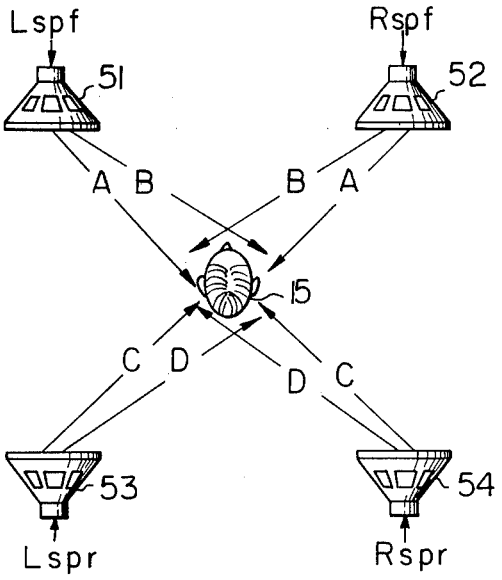

+20
+10
0
-10
Sn (dB)
0°
90°
180°
0.1
0.5
1.0
5
10
FREQUENCY (kHz)

INTENSITY DIFFERENCE (dB)
0
-10
-20
0°
30°
90°
60°
0.1
0.5
1
5
10
FREQUENCY (kHz)

TIME DIFFERENCE (μ sec)
1400
1200
1000
800
600
400
200
90°
60°
30°
0°
0.1
0.5
1.0
5
10
FREQUENCY (kHz)

STEREOPHONIC SOUND REPRODUCTION SYSTEM

FIELD OF THE INVENTION

The present invention relates generally to stereophonic sound reproduction systems. More specifically, the invention relates to reproduction of original sound sources by utilizing a monaural-to-binaural signal converter to localize the virtual sound sources at desired location in a listening area, in combination with a crosstalk cancellation converter to minimize the effect of crosstalk when the binaural signals are reproduced in the listening area.

SUMMARY OF THE INVENTION

An object of the invention is to provide a stereophonic sound reproduction system which permits localization of the original sound source without the effect of crosstalk which arises when the binaural signal is reproduced in a listening area.

Another object of the invention is to provide a stereophonic sound reproduction system which is simple in construction and easy to operate.

A further object of the invention is to provide a stereophonic sound reproduction system which gives a sense of expanded stage-width to a listener.

In accordance with a first aspect of the invention, there is provided a stereophonic sound reproduction system which comprises a first signal converter receptive of an audio input signal for converting the same into a binaural signal which carries information as to the localization of the original sound source associated with the input signal at a desired location with respect to a listener in a listening area, and a second signal converter connected to the output of said first signal converter to receive the binaural signal for converting the same into a signal having no acoustical components which would produce a crosstalk between the listener's ears when the last-mentioned signal is reproduced in said listening area.

In accordance with a second aspect of the invention, there is provided a quadraphonic sound reproduction system which comprises a first signal converter receptive of an audio input signal for converting the same into a binaural signal which carries information as to the localization of the original sound source associated with the input signal at a desired location with respect to a listener in a listening area, the first converter including first filter means receptive of the audio input signal for converting the same into a first signal having a frequency response characteristic determined by the localized point of the original sound source with respect to the listener, and second filter means receptive of the first signal for converting the same into a second signal representing the difference in intensity and propagation time over the frequency range of the first signal between a first acoustic signal which would be received at one ear of the listener when the first signal is represented in the listening area and a second acoustic signal which would be received at the opposite ear of the listener when the second signal is reproduced in the listening area; a second signal converter having right- and left-channel input terminals receptive of the first and second signals from the first signal converter, respectively, for converting the first and second signals into front-right and front-left signals having no acoustical components which would produce a crosstalk between the listener's ears when the last-mentioned signals are reproduced in said listening area; and a third signal converter having right and left channel input terminals receptive of the first and second signals from the first signal converter, respectively, for converting the first and second signals into rear-right and rear-left signals having no acoustical components which would produce a crosstalk between the listener's ears when the last-mentioned signals are reproduced in the listening area.

BRIEF DESCRIPTION OF THE DRAWINGS

These and other objects, features and advantages of the present invention will be understood from the following description taken in conjunction with the accompanying drawings, in which:

FIG. 1 is a schematic illustration of a first embodiment of the invention;

FIG. 2 is an illustration of a geometry of a virtual sound source with respect to a listener;

FIG. 9 is an illustration of a geometry of four speakers useful for describing the operation of the circuit of FIG. 8;

DESCRIPTION OF THE PREFERRED EMBODIMENTS

Figure 3:
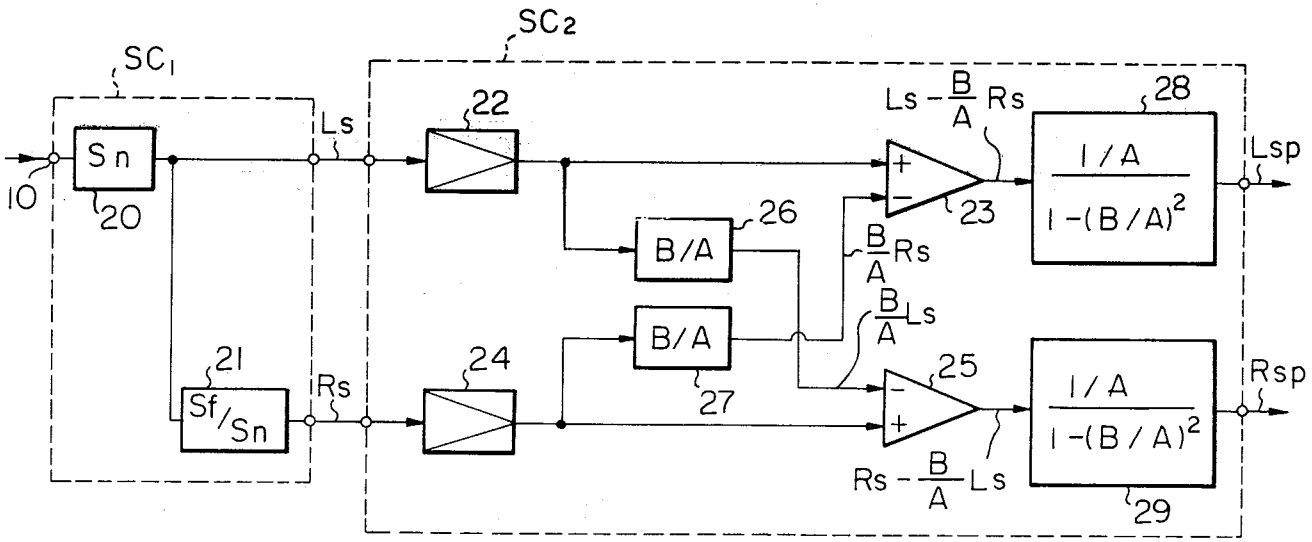
FIG. 3 illustrates the details of the embodiment of FIG. 1.

FIG. 1 is a diagrammatic illustration of a binaural sound reproduction system of the invention. A terminal 10 is adapted to receive a monaural electrical signal and supplies it to a signal converter $SC_1$ which converts the input signal applied thereto into binaural signals which bear information as to the localization of the original sound source. The monaural signal applied to the input terminal 10 is a signal representative of a single sound source picked up by a single microphone. The signal converter $SC_1$ is designed to exhibit particular frequency response and delay characteristics which faithfully represent what a person actually located in the position of the microphone would hear as by utilizing microphones positioned at the ears of a dummy head duplicating a typical human head. Therefore, the signals Ls and Rs appearing at the output leads 11 and 12 respectively represent what a person located in the sound field of interest would hear at his left and right ears. If these signals are applied to the listener by means of a stereophonic headset, an enhanced effect of directionality would be produced known as "binaural effect." However, if these signals are used to drive respective loudspeakers in order to produce a stereophonic sound field, each ear actually hears sound coming from both loudspeakers which has the effect of degrading the system, known as "crosstalk."

The signals Ls and Rs are coupled to a second signal converter $SC_2$ which compensates for such crosstalk so that the output signals Lsp and Rsp for left and right loudspeakers 13 and 14 respectively would generate an acoustic signal which, upon reaching each ear of a listener 15 located substantially at equal distances from the loudspeakers 13 and 14, will impart the sensation of binaural effect.

FIG. 2 is an illustration of the original sound source located with respect to the listener and useful for evolving the particular operating characteristics of the signal converter $SC_1$. It is assumed that sound source 16 emanates an acoustic signal S and is located in a position angularly displaced by an amount represented by $\theta$ from a line 17 which is aligned to the orientation of the listener's head 15. Therefore, in the illustration of FIG. 2, the listener 15 receives different acoustic signals as represented by Le' and Re' at his left and right ears respectively over the paths possessing acoustic transmission characteristics represented by Sn and Sf, respectively. Therefore, the following relations hold in matrix representation:

$$\begin{bmatrix} Le' \\ Re' \end{bmatrix} = S \cdot \begin{bmatrix} Sn \\ Sf \end{bmatrix} \tag{1}$$

It is assumed that the listener 15 in the illustration of FIG. 1 receives acoustic signal represented by Le and Re at his left and right ears, respectively, and the acoustic transmission characteristics as possessed by respective transmission paths to the listener's ears are represented by A and B where A is a transmission characteristic over the direct path through which the acoustic signal reaches the nearest ear and B, a transmission characteristic which contributes to the generation of crosstalk. If Ls = Le' and Rs = Re', the following relations hold:

$$\begin{bmatrix} Ls \\ Rs \end{bmatrix} = \begin{bmatrix} Le' \\ Re' \end{bmatrix} = S \cdot Sn \begin{bmatrix} 1 \\ Sf/Sn \end{bmatrix} \tag{2}$$

It will be understood that $$Sn \begin{bmatrix} 1 \\ Sf/Sn \end{bmatrix}$$

is the desiredcharacteristic which the signal converter $SC_1$ should be designed to prossess.

In order for the signals Ls and Rs to be identical to the signals Le and Re, respectively, when signals Lsp and Rsp are fed into the respective loudspeakers 13 and 14, the following relations should hold in the listening area:

$$\begin{bmatrix} Le \\ Re \end{bmatrix} = K \begin{bmatrix} Lsp \\ Rsp \end{bmatrix} \tag{3}$$

where, $$K = \begin{bmatrix} A & B \\ B & A \end{bmatrix}$$

Therefore, Lsp and Rsp are given by $$\begin{bmatrix} Lsp \\ Rsp \end{bmatrix} = T \cdot K^{-1} \begin{bmatrix} Ls \\ Rs \end{bmatrix} \tag{4}$$

where, T is a delay time which must be included for practical purposes and $K^{-1}$ is an inverse matrix of K. By rewriting Equation (4) the following equations are obtained.

$$Lsp = \frac{1/A}{1-(B/A)^2}\left(Ls - \frac{B}{A} Rs\right) T \tag{4a}$$

$$Rsp = \frac{1/A}{1-(B/A)^2}\left(Rs - \frac{B}{A} Ls\right) T \tag{4b}$$

FIG. 3 depicts the details of the converters $SC_1$ and $SC_2$ which respectively realize Equation (2), and Equation (4*a*) and (4*b*). As illustrated in FIG. 3, the signal converter $SC_1$ comprises a filter circuit 20 having a frequency response characteristic determined by the desired angle $\theta$ as referred to above and a circuit 21 which is comprised by a filter-and-delay network possessing a frequency response and a frequency vs. time difference characteristic determined in accordance with the angle $\theta$. The filter circuit 20 is designed to possess the characteristic Sn while the filter-and-delay network 21 is designed to possess the characteristic Sf/Sn.

Figure 4:
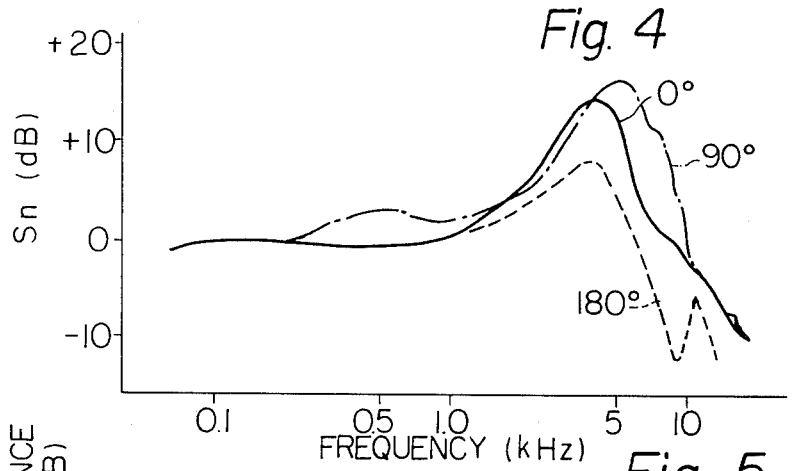
FIGS. 4 to 6 illustrate graphical representations of the transfer characteristics possessed by a sonic localization converter of FIG. 3.

FIG. 4 depicts the frequency response curves which represent the transfer characteristic Sn exhibited by the filter network 20 which establishes resonant peak or peaks in the transfer characteristic as determined by the displacement angle $\theta$ referred to above. As illustrated in FIG. 4, the resonant peak occurs at approximately 4 kHz for a displacement angle of zero degree and shifts to approximately 5 kHz for $\theta = 90°$ with a small peak of hump occurring at 0.5 kHz. For a displacement angle of 180°, a primary peak occurs at approximately 4 kHz and a small peak at approximately 10 kHz with an anti-resonant dip at approximately 9 kHz. Once the displacement angle $\theta$ is determined, a particular transfer characteristic Sn is thus determined. It will be recognized by those skilled in the art that a variety of circuit syntheseis or filter design techniques can be utilized to design a filter network 20 of FIG. 3 to approximate the desired frequency response curve depicted in FIG. 4.

Figure 5:
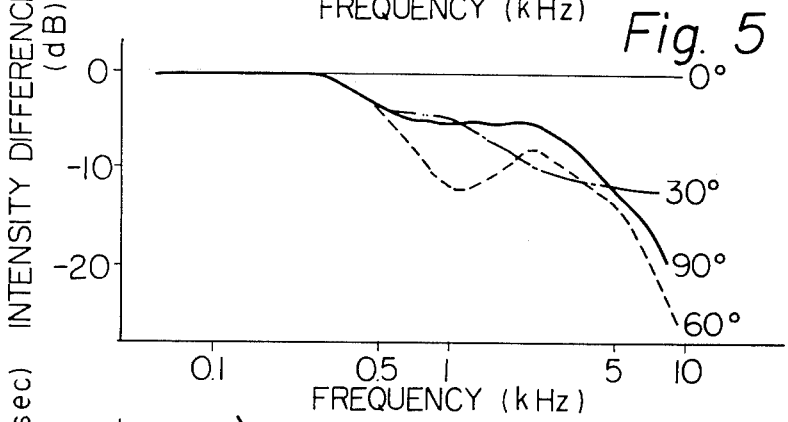

FIG. 5 depicts frequency response curves which represent the intensity-differential component of the transfer characteristic Sf/Sn exhibited by the filter-and-delay network 21. As depicted in FIG. 5, the intensity difference between signals Le' and Re' increases with frequency in the range from approximately 0.2 kHz to 10 kHz and varies widely between displacement angles.

Figure 6:
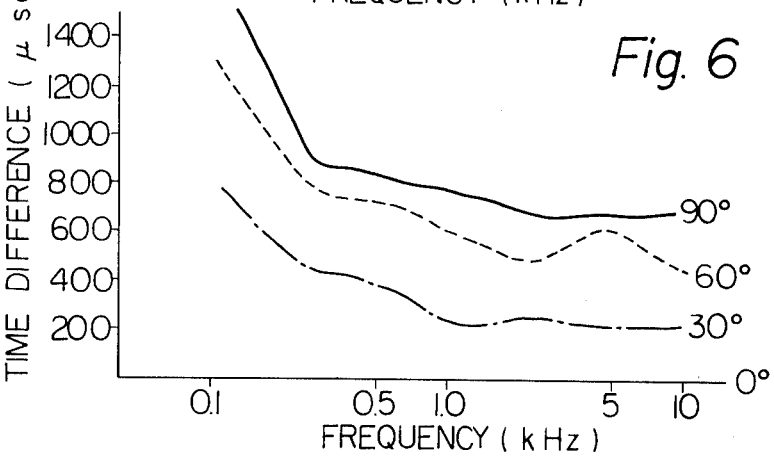

FIG. 6 depicts frequency response curves which represent the time-differential component of the transfer characteristic Sf/Sn exhibited by the filter-and-delay network 21. The difference in transmission time between signals Le' and Re' is plotted against frequency. As illustrated, the time difference decreases generally as the frequency increases and differs widely between displacement angles.

It will be understood by those skilled in the art that the filter-and-delay network 21 can be constructed to approximate the response curves as depicted in FIGS. 5 and 6 utilizing a variety of circuit synthesis or filter design techniques as mentioned above. The transfer characteristics illustrated in FIGS. 4 to 6 can be obtained by utilizing a microphone positioned in a dummy head duplicating a typical head and plotting the microphone output against frequency.

Referring again to FIG. 3, the filter network 20 transfers the input signal applied to terminal 10 in accordance with its transfer characteristic depicted in FIG. 4 and delivers its output as a signal Ls to the signal converter $Sc_2$ and also to the filter-and-delay network 21. The latter provides transformation of the frequency response of the input signal from the previous stage 20 in accordance with its operating characteristics as depicted in FIGS. 5 and 6 and delivers its output as a signal Rs to the converter $SC_2$.

As previously described, the converter $SC_2$ provides crosstalk cancellation of the input signals Ls and Rs delivered from the converter $SC_1$. The input signal Ls is applied through buffer amplifier 22 to the noninverting input of a comparator or subtractor 23. The output of the amplifier 22 is also coupled to the inverting input of a comparator or subtractor 25 by means of a filter network 26 having a transfer characteristic represented by B/A. The signal Rs is applied through buffer amplifier 24 to the noninverting input of the comparator 25 and also to the inverting input of the comparator 23 via filter network 27 having the same transfer characteristic as filter network 26. Therefore, the signal at the output of comparator 23 represents Ls − (B/A)Rs and the signal at the output of comparator 25 respresents Rs − (B/A)Ls. Each of these signals if fed to a respective one of identical filter networks 28 and 29 having a transfer characteristic $$\frac{1/A}{1-(B/A)^2}.$$

Therefore, the output from each of the networks 28 and 29 is a multiplication of the input characteristic by the transfer characteristic of each of the networks 28, 29, thus satisfying Equations (4a) and (4b).

The networks 26 to 29 are each constituted by a filter circuit and a delay circuit utilizing the circuit synthesis techniques to approximate the respective transfer characteristics required.

Figure 7:
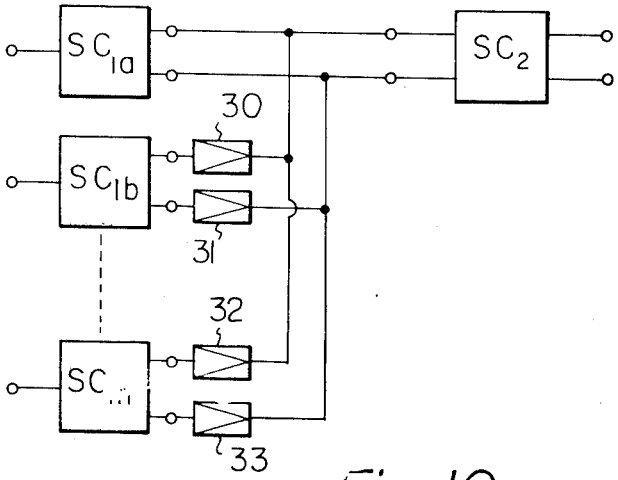
FIG. 7 illustrates a modification of FIG. 1.

FIG. 7 illustrates a modification of the embodiment of FIG. 3. A plurality of converters $SC_{1a}$ to $SC_{1n}$ is provided for connection to corresponding sources of electrical signals each representing a monaural acoustic signal. These monaural signals are converted by the respective transfer characteristic effected by the corresponding signal converter in a manner identical to that described above so that a plurality of binaural signals is produced at the output of converters $SC_{1a}$ to $SC_{1n}$. The output from the converter $SC_{1a}$ is connected to the input of converter $SC_2$ and the outputs from converters $SC_{1b}$ to $SC_{1n}$ are connected via a respective one of buffer amplifiers 30 to 33 to the converter $SC_2$.

Each of the converters $SC_{1a}$ to $SC_{1n}$ is designed such that the corresponding transfer characteristics represent frequency response curves determined by particular displacement angles in order to impart a sense of presence in a sound field in which the listener would receive acoustic signals coming from various virtual sound sources with an enhanced directionality corresponding to the above-mentioned displacement angles.

Figure 8:
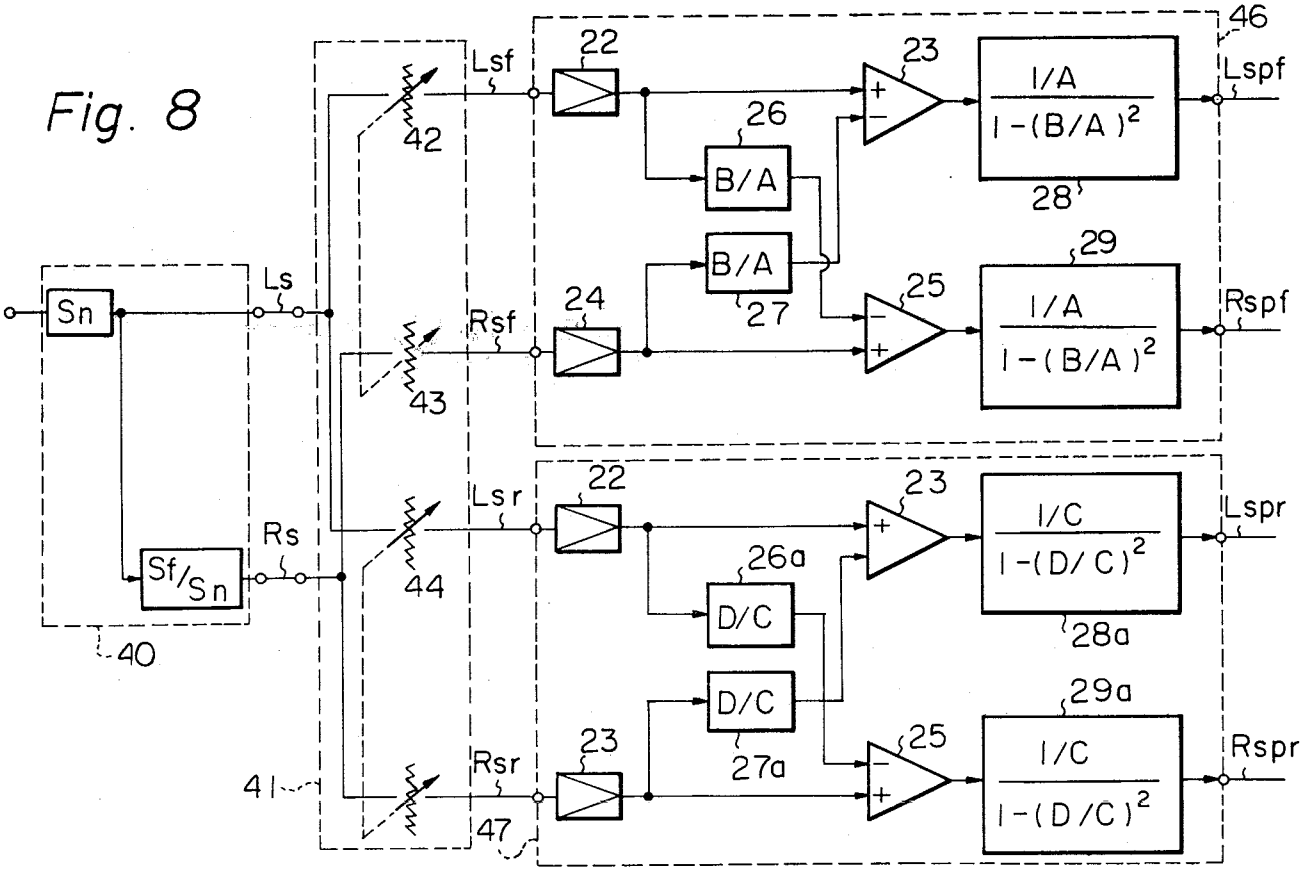
FIG. 8 is an illustration of a quadraphonic sound reproduction system incorporating the converters of FIG. 3.

A four-channel stereophonic or quadraphonic sound system can also be realized by utilizing the embodiments previously described. FIG. 8 depicts a typical embodiment of the quadraphonic system which generally comprises a sonic localization converter 40 identical in construction to the converter $SC_1$ of FIG. 3, a channel controller 41 constituted by four variable attenuators 42 to 45, a crosstalk cancellation converter 46 identical to the converter $SC_2$ of FIG. 3 and another crosstalk cancellation converter 47. The converter 40 is designed to transfer the input signal in accordance with a desired frequency response characteristic as mentioned above to generate a pair of binaural signals Ls and Rs. The left channel output of converter 40 is connected to the converter 46 via variable attenuator 42 as a front-left signal Lsf and also to the converter 47 variable attenuator 44 as a rear left-signal Lsr. The right channel output of converter 40 is connected via attenuator 43 to the converter 46 as a front-right signal Rsf and also to the converter 47 via attenuator 45 as a rear right signal Rsr. The attenuators 42 and 43 are ganged together and attenuators 44 and 45 are also ganged together to effect simultaneous adjustments.

Referring to FIG. 9, a quadraphonic speaker system is shown. Front speakers 51 and 52 and rear speakers 53 and 54 are arranged in pairs in front and rear of the listener 15. The listener 15 is assumed to receive the acoustic signal having the same transmission characteristics A and B as shown in FIG. 1. Because of the difference in external contour of the listener 15 between the front and rear sides of his head, transmission characteristics of the rear side of the sound field is different from the respective transmission characteristics in the front side of the listener. As illustrated, the transmission characteristic of the acoustic signals that propagate over the shortest path are denoted by C and the signals that contribute to the generation of crosstalk effect are represented by D.

The converter 47 is constructed by similar elements to those which constitute the converter 46 with the exception that elements 26a and 27a are each designed to exhibit the transfer characteristic D/C and elements 28a and 29a are each designed to exhibit the transfer characteristic $$\frac{1/C}{1-(D/C)^2}.$$

The signals obtained at the output of the converters 46 and 47 are represented by the following equations:

$$Lspf = \frac{1/A}{1-(B/A)^2}\left(Ls - \frac{B}{A}Rs\right)T \qquad (5a)$$

-continued $$Rspf = \frac{1/A}{1-(B/A)^2}\left(Rs - \frac{B}{A}Ls\right)T \quad (5b)$$

$$Lspr = \frac{1/C}{1-(D/C)^2}\left(Ls - \frac{D}{C}Rs\right)T \quad (5c)$$

$$Rspr = \frac{1/C}{1-(D/C)^2}\left(Rs - \frac{D}{C}Ls\right)T \quad (5d)$$

where,

Lspf = signal applied to front left speaker 51
Rspf = signal applied to front right speaker 52
Lspr = signal applied to rear left speaker 53
Rspr = signal applied to rear right speaker 54

The channel controller 41 permits localization of sonic images by adjusting the attenuators 42 to 44. If it is desired to localize the sonic point of interest in front of the listener 15, the attenuators 42 to 45 are adjusted to allow the signals to be applied only to the converter 46 while suppressing the signals to the converter 47 to a minimum. Conversely, localization is effected in rear side of the listener by adjustment which allows the signals to be applied only to the converter 47 while allows the signals to be applied only to the converter 47 while suppressing the signals to the converter 46 to a minimum. It will be understood therefore that localization of a sonic point in the lateral side of the listener is effected by adjustment which permits the signals from the converter 40 to be applied to both converters 46 and 47 at appropriately proportioned relative levels. When sonic point is localized at the lateral side of the listener, he would experience a sense of impression that sound comes from his lateral side even though he turns his head through an angle of 90° from the position as indicated in FIG. 9 to face the speakers 51 and 53.

Figure 10:
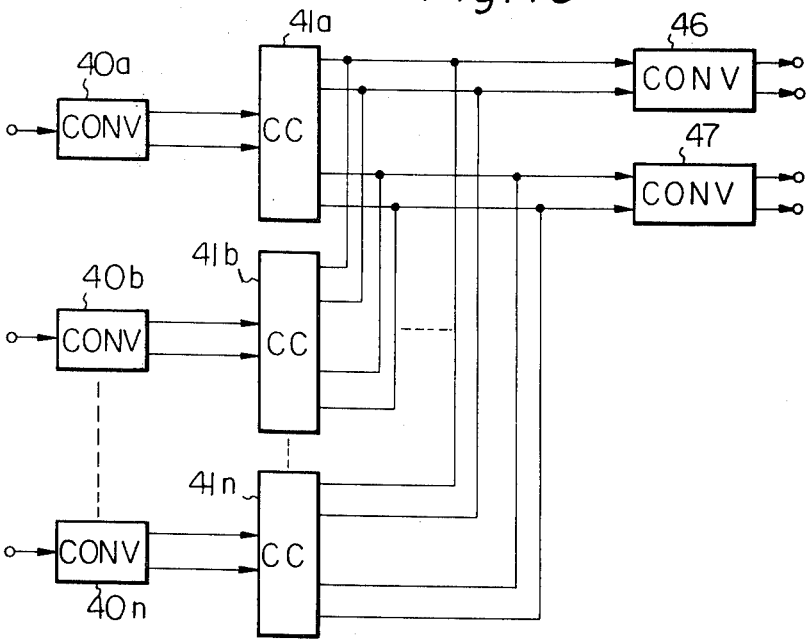
FIG. 10 is a modification of the embodiment of FIG. 8.

FIG. 10 depicts a quadraphonic reproduction system of the invention incorporating the elements employed in the embodiment of FIG. 8. For convenience, elements common to FIGS. 8 and 10 are identified by the same numerals. There is provided a plurality of sonic localization converters 40 each having a particular transfer characteristic in accordance with a desired locality of sonic point as described above. The output signals from each converter 40 are connected to the converters 46 and 47 via a respective one of a plurality of channel controllers 41 in a manner identical to that shown in FIG. 8. Localization of various sonic points is thus effected in a quadraphonic sound field by the procedures as described in connection with the embodiment of FIG. 8.

Figure 11:
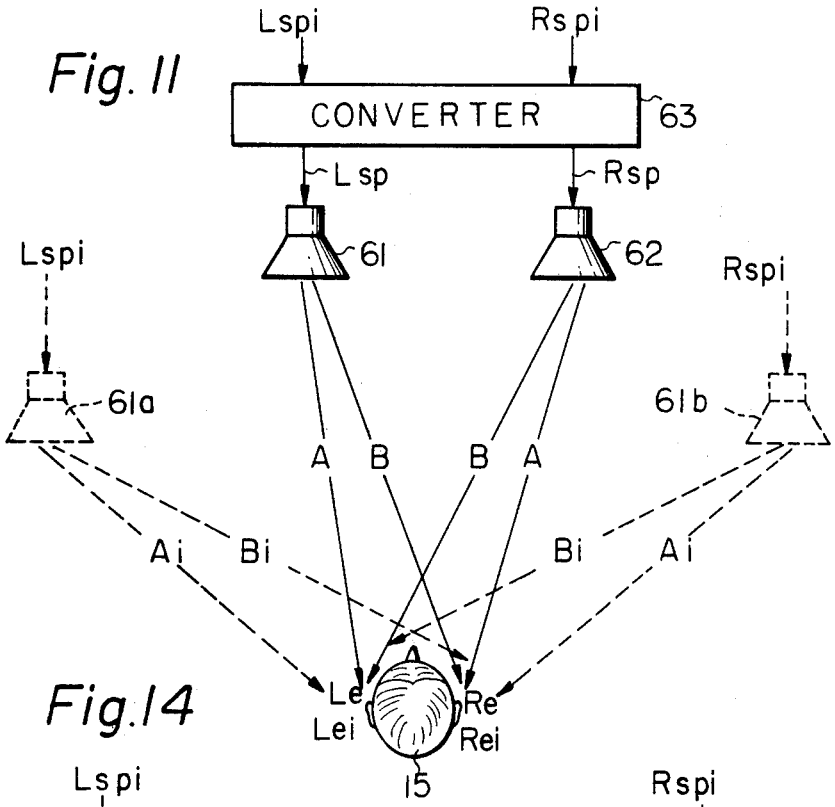
FIG. 11 illustrates a second embodiment of the invention in which the converter is modified to give a sense of expanse of the listening area.

Because of the limitations of space available for positioning loudspeakers, the re-created sound field is often confined within a small area and the listener would hear sound coming from a limited angle. Under such circumstances, it is desirable to give a sense of expanse such that sound comes from a wider angle as if the speakers were separated a greater distance apart than they actually are. FIG. 11 depicts an arrangement of speakers relative to the listener in the actual locations in solid lines and hypothetical locations in broken lines. Numerals 61 and 62 respectively designate left and right loudspeakers located in actual positions and supplied with signals Lsp and Rsp, respectively, from a converter 63. Hypothetical speakers 61*a* and 62*a* are shown separated a greater distance apart than the distance the actual speakers 61 and 62 are separated apart. Assuming that the hypothetical speakers 61*a* and 62*a* and the converter 63 are supplied with a set of signals Lspi and Rspi and that transmission characteristics over direct acoustic paths be denoted by A and Ai for actual and hypothetical signals, respectively, and those over the acoustic crosstalk paths be denoted by B and Bi for actual and hypothetical signals, respectively. Equation (3) hold between the signals received by the respective ears of the listener 15 and the signals supplied to the speakers 61 and 62, and the following relations exist between the signals supplied to the hypothetical speakers 61*a* and 62*a* and the signals which would be received at the listener's ears:

$$\begin{bmatrix} Rei \\ Lei \end{bmatrix} = \begin{bmatrix} Ai & Bi \\ Bi & Ai \end{bmatrix} \begin{bmatrix} Rspi \\ Lspi \end{bmatrix} \quad (6)$$

Since the relations Re = Rei and Le = Rei must exist for the hypothetical assumption, Equation (3) can be rewritten as follows:

$$\left.\begin{aligned} Rsp &= \frac{1}{A}Rei - \frac{B}{A}Lsp \\ Lsp &= \frac{1}{A}Lsi - \frac{B}{A}Rsp \end{aligned}\right\} \quad (7)$$

From Equations (6) and (7), the following equation is obtained:

$$\left.\begin{aligned} Rsp &= \frac{Ai}{A}\left(Rspi + \frac{Bi}{Ai}Lspi\right) - \frac{B}{A}Lsp \\ Lsp &= \frac{Ai}{A}\left(Lspi + \frac{Bi}{Ai}Rspi\right) - \frac{B}{A}Rsp \end{aligned}\right\} \quad (8)$$

Equation (8) represents the relations between the signals to be supplied to the hypothetical or virtual speakers 61*a* and 62*a* to the converter 63.

Figure 12:
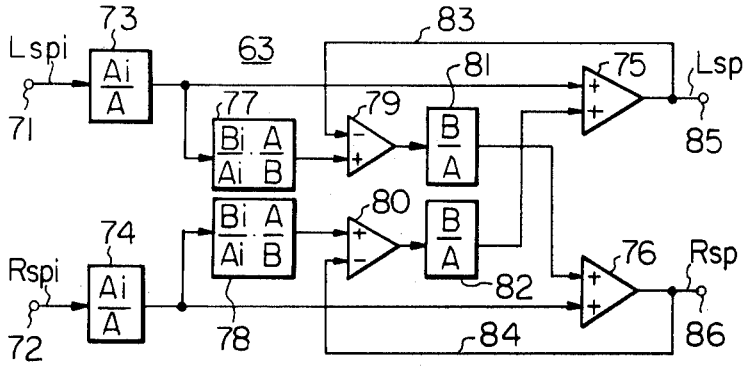
FIG. 12 illustrates the details of the converter of FIG. 11.

FIG. 12 depicts the details of the converter 63 which realizes the formation of signals Rsp and Lsp. The converter 63 comprises a left channel input terminal 71 adapted to receive the hypothetical left channel signal Lsp*i* and a right channel input terminal 72 which is adapted to receive the hypothetical right channel signal Rspi. The input signal Lspi is coupled to a filter-and-delay network 73 which is designed to exhibit the transfer characteristic A*i*/A. The output of the network 73 is connected to a first input terminal of an adder 75 and also to the noninverting input of a comparator 79 through a filter-and-delay network 77 having a transfer characteristic (Bi/Ai) (A/B). The output of the comparator 79 is in turn connected to a filter-and-delay network 81 having a transfer characteristic B/A, whose output is connected to a second input of an adder 76. Similarly, the input signal Rspi is coupled to a filter-and-delay network 74 having the same transfer characteristic as network 72, the output of network 74 being connected to the first input of the adder 76 and to the noninverting input of comparator 80 via filter-and-delay network 78 having the same transfer characteristic as network 77. The output of the comparator 80 is coupled to the second input of the adder 75 by means of a filter-and-delay network 82 having the same transfer characteristic as network 81. The output of adders 75 and 76 are connected by feedback connections 83 and 84 to the inverting input of the comparators 79 and 80, respectively, and also connected to output terminals 85 and 86, respectively. Therefore, the left and right channels have a symmetrical circuit relationship to each other.

The operation of circuit 63 of FIG. 12 can be verified by tracing out each circuit branch as follows. The signal at the output of the network 77 is (B*i*/B)L*spi* which is used to bias the noninverting input of comparator 79 for comparison with a signal at its inverting input. Since the output signal can be assumed to take the value of L*sp*, which is fed back to the inverting input of comparator 80, the output of comparator 79 is simply a subtraction of its two input signals, that is, (B*i*/B)L*spi* − L*sp*. Since the output of network 81 is symmetrically opposite to the output of network 82, the input signal to the second input of adder 75 is (B*i*/A)R*spi* − (B/A)R*sp*. Therefore, the output of adders 75 and 76 satisfies Equation (8).

Figure 13:
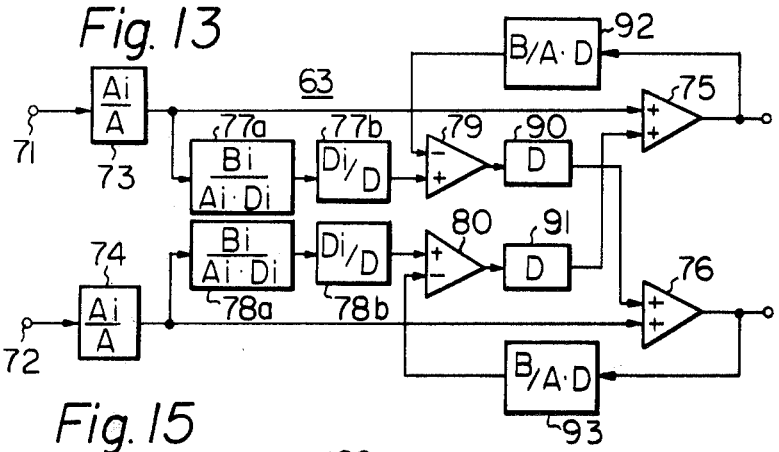
FIG. 13 illustrates a modification of the converter of FIG. 12.

FIG. 13 depicts a modification of the converter 63 of FIG. 12. In the modified form of converter 63, the transfer characteristic D represents the delay vs. frequency characteristic (phase shift component) of the transfer characteristic B/A, and D*i* represents the delay vs. frequency characteristic (phase shift component) of the transfer characteristic B*i*/A*i*. The overall transfer characteristic of the modified circuit is identified to that of FIG. 12. The network 77 of FIG. 12 is divided into a filter circuit **77*a* and a delay or phase-shifting circuit 77*b* which are series connected. The circuit 77*a*** is designed to have a transfer characteristic B*i*/A*i*.D*i* and the delay circuit **77*b*** is designed to exhibit a delay transfer characteristic D*i*/D. The output of comparator 79 is connected to a phase-shifting circuit 90 having the delay characteristic D, whose output is connected to the adder 76. The output of adders 75 and 76 are connected to the comparators 79 and 80 by means of filter circuits 92 and 93, respectively, each having a transfer characteristic B/A.D. Similarly, the network 78 of FIG. 12 is replaced by a series circuit branch including a filter circuit **78*a* and a delay circuit 78*b* having the same characteristics as circuits 77*a* and 77*b***, respectively.

Figure 14:
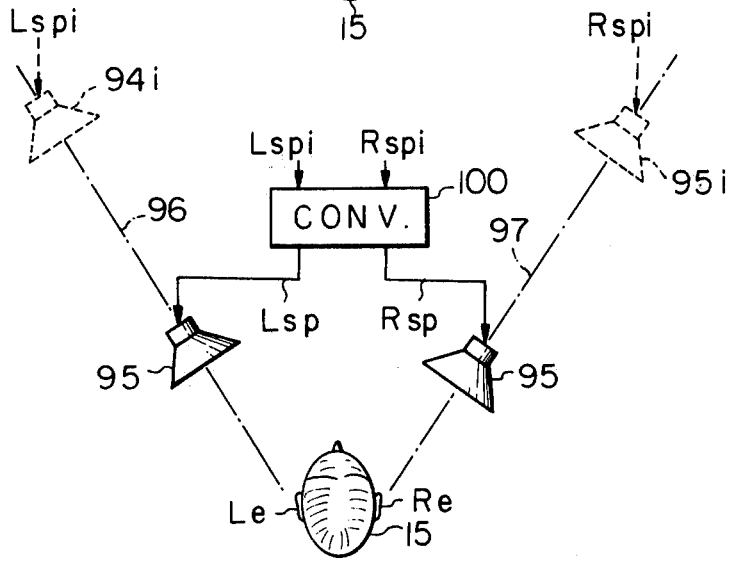
FIG. 14 illustrates a third embodiment of the invention in which the converter is modified to give a sense of expanse of the listening area.

The sense of expanse can also be given by considering the hypothetical speakers being located in an extension of the line between the locations of the listener and actual speakers, as illustrated in FIG. 14. In the illustration of FIG. 14, the hypothetical speakers are identified by numerals **94*i* and 95*i* and the actual speakers, 94 and 95 which are located adjacent to the listener 15** and supplied with signals L*sp* and R*sp*, respectively, from a converter 100 which converts hypothetical signals L*spi* and R*spi* which are assumed to have been supplied to the hypothetical speakers **94*i* and 95*i*, respectively. The hypothetical speakers 94*i* and 95*i* are located along the dot-and-dash lines 96 and 97, respectively, which radially extend from the listener's location passing through the locations of the actual speakers 94 and 95. It is thus assumed that the listener would hear sound coming from virtual sound sources located a distance away from the actual points of sound sources. Since the hypothetical speakers are simply located away from the actual sound sources while their angular positions remain unchanged with respect to the listener 15**, there is no difference in transmission characteristics between actual and hypothetical acoustic signals. The sense of expanse can therefore be realized by considering only the difference in signal level between the actual and hypothetical acoustic signals. Therefore, Equation (8) can be rewritten as follows:

$$Rsp = Rspi + \frac{B}{A} Lspi - \frac{B}{A} Lsp \qquad (9)$$

-continued $$Lsp = Lspi + \frac{B}{A} Rspi - \frac{B}{A} Rsp$$

Figure 15:
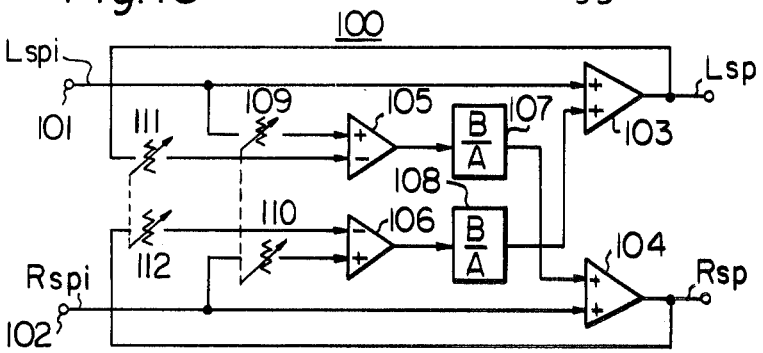
FIG. 15 illustrates the details of the converter of FIG. 14.

Equation (9) is embodied by the converter 100 which is separately shown in FIG. 15 as comprising a left-channel input terminal 101 adapted to receive signal L*spi* and a right-channel input terminal 102 adapted to receive signal R*spi*. Signal L*spi* is connected to an input of an adder 103 and also to the noninverting input of a comparator 105 for comparison with signal L*sp* at the inverting input connected from the output of adder 103. A filter-and-delay network 107 having a transfer characteristic B/A couples the output of comparator 105 to an input of a right-channel adder 104, whose output is connected to the inverting input of a comparator 106 for comparison with the input signal R*spi* on terminal 102. The second input of the left-channel adder 103 is fed with a signal from a filter-and-delay network 108 having the same transfer characteristic as network 107, which modifies the output from the comparator 106 in accordance with its transfer characteristic. Variable attenuators 109 and 110, which are ganged together, are interposed in the circuit to the noninverting input of comparators 105 and 106, respectively, and variable attenuators 111 and 112, which are ganged together, are interposed in the circuit to the inverting input of the comparators 105 and 106, respectively.

Upon examination of FIG. 15 it will be understood that the losses introduced by the attenuators 109 and 110 can effectively vary the distance between the listener 15 and the hypothetical speakers **94*i* and 95*i*: that is, with a minimum attenuation loss the listener 15 will be given a sense of enhanced expanse of sound field which causes him to have the sense of hearing sound coming from a point away from the point otherwise localized by the signal not processed by the converter 100. Conversely, with a maximum attenuation loss provided by attenuators 109 and 110**, the listener would have an impression of hearing sound coming from a stereophonic headset.

Adjustment of attenuators 111 and 112 controls the degree of compensation of signals that contribute to crosstalk. Thus, the introduction of a maximum loss in the respective circuits will generate a binaural signal which is only suitable for reproduction through the use of a stereophonic headset.

Figure 16:
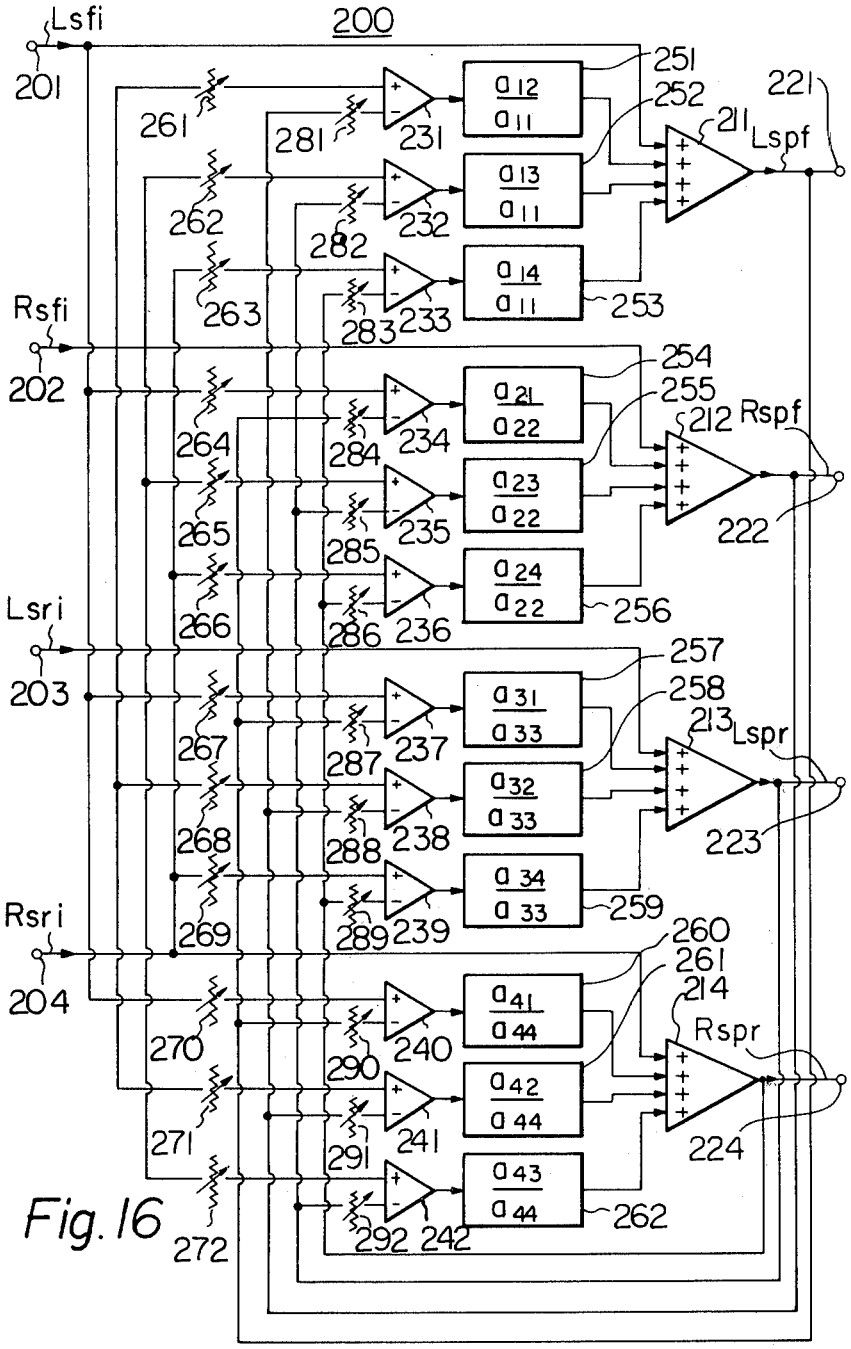
FIG. 16 is a circuit block diagram of a modified embodiment of FIG. 15.

FIG. 16 illustrates a modification of FIG. 15 for quadraphonic reproduction. The quadraphonic sound expansion converter 200 comprises a front-left channel input terminal 201, a front-right channel input terminal 202, a rear-left channel input terminal 203 and a rear-right channel input terminal 204. Each of these input terminals is connected to an input of a respective one of adders 211, 212, 213 and 214, whose outputs are respectively connected to output terminals 221, 222, 223 and 224. A plurality of comparators 231 through 242 is provided having their outputs connected respectively to the input of filter-and-delay networks 251 through 262, whose outputs are in turn connected to the input of associated adders as illustrated.

The input terminal 201 is also connected to the noninverting input of comparators 234, 237 and 240 for comparison with the output from adder 211 to apply the results of comparison to the networks 254, 257 and 260, respectively. The input terminal 202 is connected to the noninverting input of comparators 231, 238 and 241 for comparison with the output from adder 212 to apply the results of comparison to the networks 251, 258 and 261.

The input terminal 203 for rear-left channel is also connected to the noninverting input of comparators 232, 235 and 242 for comparison with the output from adder 213 to apply the results of comparison to the networks 252, 255 and 262, respectively. Similarly, the input terminal 204 is also connected to the noninverting input of comparators 233, 236 and 239 for comparison with the output from adder 214 to apply the results of comparison to the networks 253, 256 and 259, respectively.

The input signal applied to the noninverting terminal of each comparator is attenuated by a respective one of a plurality of variable attenuators 261 through 272, and the input signal applied to the inverting input of each comparator is also attenuated by a respective one of a plurality of variable attenuators 281 through 292.

Figure 17A:
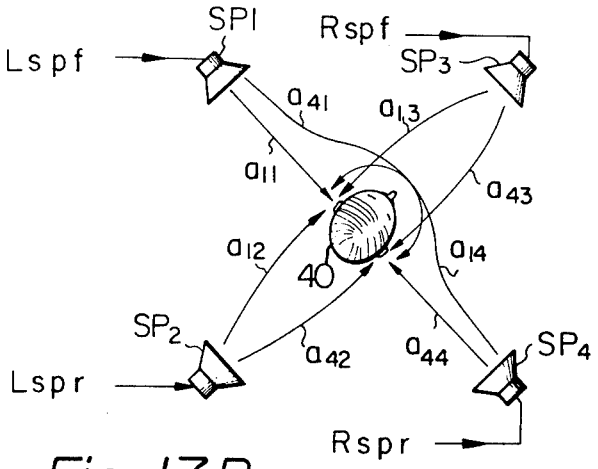
FIGS. 17A and 17B are diagrammatic illustrations useful for describing the operation of FIG. 16.
Figure 17B:
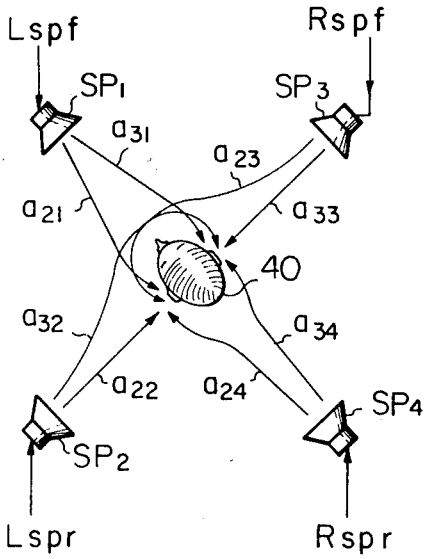

The transfer characteristic of each network is indicated in the rectangular block of each network, which represents corresponding transmission characteristic shown in FIGS. 17A and 17B. FIGS. 17A and 17B illustrate an arrangement of four speakers SP1, SP2, SP3 and SP4 for reproduction of a quadraphonic acoustic signal with the listener 15 located at equal distances from each speaker. In FIG. 17A, the listener faces rightwardly at 45° relative to a reference plane that is substantially intermediate a line drawn between loudspeakers SP1 and SP3 so as to directly face the speaker SP3. As illustrated in FIG. 17A, transmission characteristics over acoustic paths between the listener's left ear and speakers SP1, SP2, SP3 and SP4 are designated by $a_{11}$, $a_{12}$, $a_{13}$ and $a_{14}$, respectively. The transmission characteristics over acoustic paths between the listener's right ear and the speakers SP1 to SP4 are represented by $a_{41}$, $a_{42}$, $a_{43}$ and $a_{44}$, respectively.

In FIG. 17B, the listener turns his head leftwardly at 45° relative to the reference plane to directly face the speaker SP1. In this case, transmission characteristics over acoustic paths between the listener's left ear and speakers SP1 to SP4 are represented by $a_{21}$, $a_{22}$, $a_{23}$ and $a_{24}$, respectively, and transmission characteristics over acoustic paths between the listeners's right ear and speakers SP1 to SP4 are represented by $a_{31}$, $a_{32}$, $a_{33}$ and $a_{34}$, respectively.

Therefore, the transfer characteristic $a_{12}/a_{11}$ exhibited by the network 251 represents the intensity and phase differences between acoustic signals received at the listener's left ear from the speakers SP1 and SP2, and the transfer characteristic $a_{13}/a_{11}$ provided by the network 252 represents the intensity and phase differences between acoustic signals received at the listener's left ear from the speakers SP1 and SP3, and transmission characteristic $a_{14}/a_{11}$ provided by network 253 represents the intensity and phase differences between acoustic signals received at the listener's left ear from the speakers SP1 and SP4. The speaker SP1 is thus supplied with an output from adder 211 which adds up the outputs from the networks 251, 252 and 253 as well as the input signal from terminal 201. Therefore, it will be understood that each loudspeaker is supplied with a signal that corresponds to the summation of signals from the respective networks, each of which has undergone change in intensity and phase over its frequency range relative to the acoustic signals from the other speakers, plus the signal directly applied from the respective input terminal.

Figure 18:
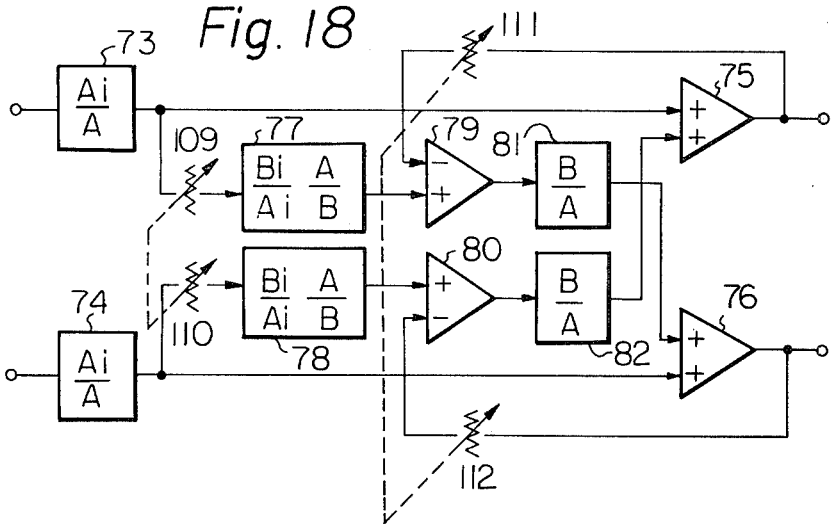
FIG. 18 shows a modified embodiment incorporating the features of the embodiments of FIGS. 12 and 15.

The circuit shown in FIG. 18 is a combination of the embodiments of FIGS. 12 and 15. For convenience, elements common to FIGS. 12, 15 and 18 are designated by the same numerals. Ganged variable attenuators 109 and 110 are interposed between the networks 73 and 77 and between the networks 74 and 78, respectively. Ganged variable attenuators 111 and 112 are interposed in the feedback circuit between the output of adder 75 and the input to comparator 79 and the feedback circuit between the output of adder 76 and the input to comparator 80, respectively. Adjustment of these attenuators in a manner as described in connection with FIG. 15 will permit localization of the sonic point at any desired place so that a desired degree of expansion of sound field is obtained.

Figure 19:
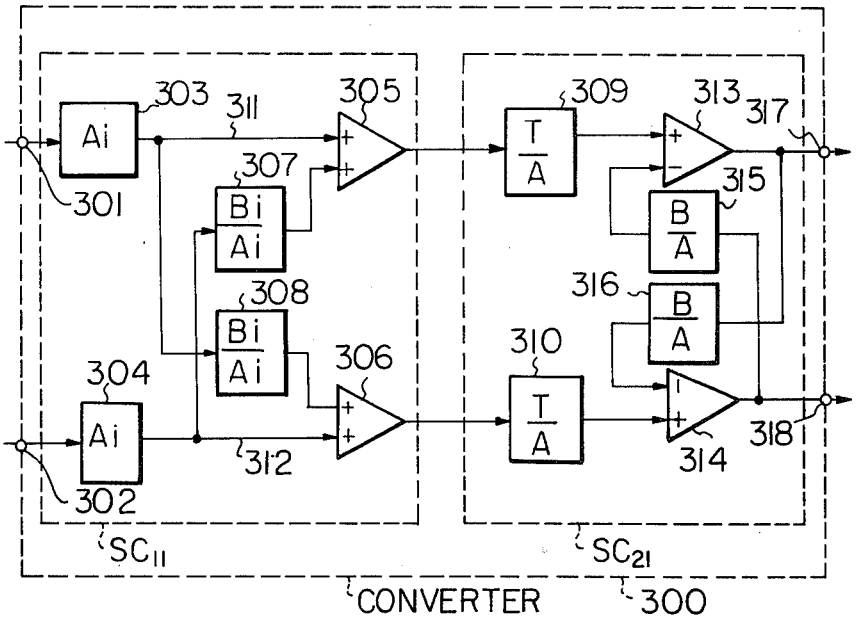
FIG. 19 is a modification of the embodiment of FIG. 12.

The embodiment of FIG. 12 can be modified as shown in FIG. 19 in which the converter 300 comprises two parts: a converter $SC_{11}$ for localization of sonic point and a converter $SC_{22}$ for cancellation of crosstalk. Converter $SC_{11}$ includes a left-channel input terminal 301 and a right-channel input terminal 302. The left-channel signal at the input terminal 301 is coupled through a filter-and-delay network 303 having a transfer characteristic A*i* to an input of an adder 305 whose output is connected to a filter-and-delay network 309 having a transfer characteristic represented by T/A, where T is a delay time. The output from the network 303 is also coupled to an input of an adder 306 by way of a filter-and-delay network 308 having a transfer characteristic B*i*/A*i*. Similarly, the right channel signal is coupled to the other input of adder 306 and also to the other input of adder 305 by way of a filter-and-delay network 307 having the same transfer characteristic as network 308.

It is seen by examination of FIG. 19 that the left-channel signal that has been applied to adder 305 on lead 311 and the left-channel signal that has undergone change in frequency and delay characteristics by means of network 308 and applied to adder 306 on lead 313, constitute a binaural signal identical to the converter $SC_1$ of FIG. 3 so that the binaural signal thus obtained at the output of adders 305 and 306 includes information as to the localization of sound source relative to the left channel. Similarly, the signal applied to adder 306 over lead 312 and the signal applied through network 307 to adder 305 constitute another binaural signal which bears information as to the localization of sound source relative to the right channel.

Therefore, it is appropriate that each of the signals applied to one of the input terminals 301 and 302 be a monaural signal derived from a separate sound source.

The output from adder 305 is thus a left-channel binaural signal which is coupled to the noninverting input of a comparator 313 of the converter $SC_{22}$ by the network 309, and the output from adder 306, which is a right-channel binaural signal is coupled to the noninverting input of a comparator 314 through a filter-and-delay network 310. Each of the outputs from the comparators 313 and 314 is cross-coupled via a respective one of filter-and-delay networks 315 and 316 to the inverting input of the other comparator and also connected to a respective output terminal 317 or 318.

It should be noted however that where the input signal applied to the converter $SC_{1a}$ is a binaural signal, the resultant output signal would not represent faithful reproduction of the original signal and, in some instances, the information as to the faithful localization of sound sources would be completely lost, particularly when the original sound source is to be localized in a plane which bisects the line connecting two front speakers. This is explained as follows:

Since Le = Lei and Re = Rei (see FIG. 11), the following equation can be obtained from Equations (3) and (6):

$$\begin{bmatrix} Rsp \\ Lsp \end{bmatrix} = T \cdot \begin{bmatrix} A & B \\ B & A \end{bmatrix}^{-1} \begin{bmatrix} Ai & Bi \\ Bi & Ai \end{bmatrix} \begin{bmatrix} Rspi \\ Lspi \end{bmatrix} \tag{10}$$

$$= \frac{T}{A^2 - B^2} \begin{bmatrix} A & -B \\ -B & A \end{bmatrix} \begin{bmatrix} Ai & Bi \\ Bi & Ai \end{bmatrix} \begin{bmatrix} Rspi \\ Lspi \end{bmatrix}$$

If the original sound source is located in exactly in front of the listener, the signals applied to the input terminals 301 and 302 would have the same frequency response and delay time characteristics. Under these circumstances, it can be assumed that $Lspi = Rspi = S$. Equation (10) can be rewritten as follows:

$$Rsp = Lsp = \frac{T}{A^2 - B^2} (A - B)(Ai + Bi) \cdot S \tag{11}$$

$$= \frac{Ai + Bi}{A + B} \cdot T \cdot S$$

Since either of transmission characteristics A + B and Ai + Bi represents the sum of individual transmission characteristics, the characteristic curve (A + B) has resonant peaks at different frequencies from those in the characteristic curve (Ai + Bi). Therefore, the input signal S to the converter 300 will experience change in frequency response and delay time as if it has applied to a circuit having many peaks and dip in the transfer characteristic.

Figure 20:
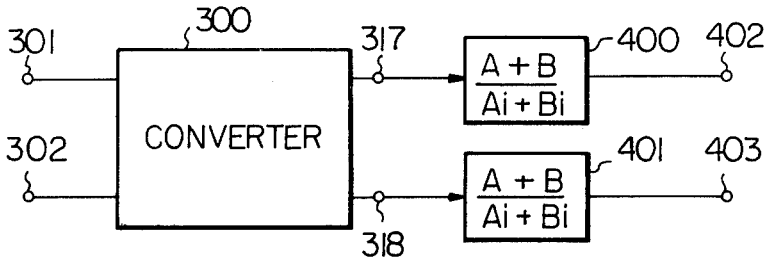
FIG. 20 is a modification of the embodiment of FIG. 19.

Therefore, it will be understood that the abovementioned problem can be solved by connecting a filter-and-delay compensating network 400 having a transfer characteristic (A + B)/(Ai + Bi) to the output terminal 317 of converter 300 and another network 401 having an identical transfer characteristic to network 400 to the output terminal 318, as illustrated in FIG. 20. Each of the compensating networks 400 and 401 can be realized by utilizing equalizing networks as disclosed in U.S. Pat. No. 3,566,294 issued to the same assignee of the present invention. Since the converter 300 exhibits the transfer characteristic which satisfies Equation (10), the overall transfer characteristic obtained at output terminals 402 and 403 can be given as follows:

$$\begin{bmatrix} Rsp \\ Lsp \end{bmatrix} = \frac{T}{A - B} \cdot \begin{bmatrix} A & -B \\ -B & A \end{bmatrix} \cdot \frac{1}{Ai + Bi} \cdot \begin{bmatrix} Ai & Bi \\ Bi & Ai \end{bmatrix} \begin{bmatrix} Rspi \\ Lspi \end{bmatrix} \tag{12}$$

Figure 21:
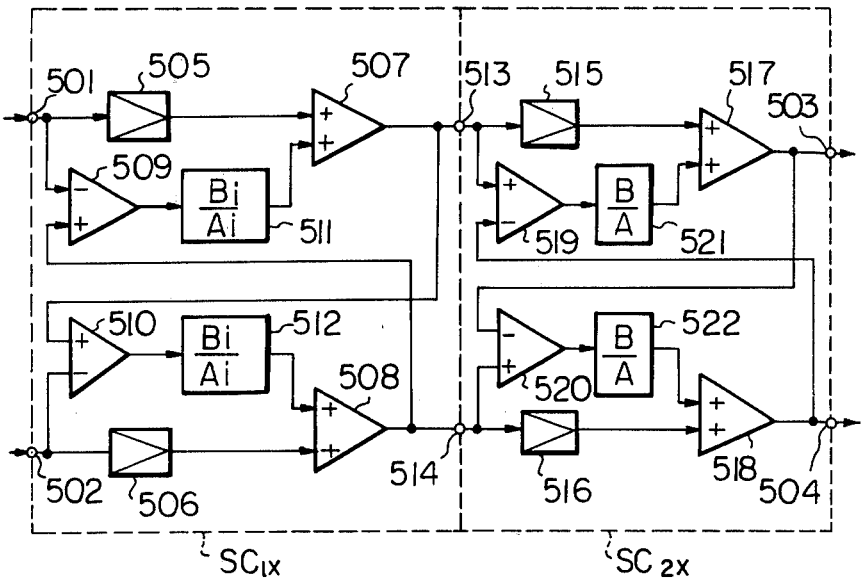
FIG. 21 is a modification of the embodiment of FIG. 20.

FIG. 21 depicts a modification of FIG. 20 which satisfies Equation (12). The converter of FIG. 21 comprises a sonic localization converter $SC_{1x}$ and a crosstalk cancellation converter $SC_{2x}$ cascaded between input terminals 501, 502 and output terminals 503, 504. The left-channel input terminal 501 is connected through an amplifier 505 to an input terminal of an adder 507 and also to the inverting input of a comparator 509 whose output is connected to the other input of an adder 507 via a filter-and-delay network 511. Similarly, the left-channel input 502 is connected through an amplifier 506 to an input of an adder 508 and also to the inverting input of a comparator 510 whose output is connected to the other input of the adder 508 via a filter-and-delay network 512. Each of the networks 511 and 512 are designed to exhibit a transfer characteristic represented by $Bi/Ai$. The output of adder 507 is cross-coupled to the noninverting input of the comparator 510 of the right channel and also to the left-channel input 513 of the converter $SC_2$. Similarly, the output of adder 508 is cross-coupled to the noninverting input of the comparator 509 of the left channel and also to the right-channel input 514 of the converter $SC_{2x}$. The converter $SC_{2x}$ has a similar circuit configuration to that of converter $SC_{1x}$. The left-channel signal at the terminal 513 is coupled through an amplifier 515 to an input of an adder 517 and also to the noninverting input of a comparator 519 whose output is connected to the other input of the adder 517 via a filter-and-delay network 521 having a transfer characteristic B/A. Similarly, the rightchannel signal on input terminal 514 is coupled to an input of adder 518 through an amplifier 516 and also to the noninverting input of a comparator 520 whose output is in turn connected to the other input of adder 518 via a filter-and-delay network 522 having the same transfer characteristic as the network 521. The output of adder 517 is cross-coupled to the inverting input of the comparator 520 and also to the left-channel output terminal 503. Similarly, the output of adder 518 is cross-coupled to the inverting input of the comparator 510 and also to the right-channel output terminal 504. The embodiment of FIG. 21 has an advantage over the circuit of FIG. 20 in that the circuit of FIG. 21 can be constructed of four filter networks of two different transfer characteristics, while the latter comprises ten filter networks of five different transfer characteristics.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. Apparatus for deriving signals to be applied to a multi-channel sterophony using loudspeakers in spaced relation with respect to a listener, comprising;

binaural localization circuit means receptive of signals from a first signal source for developing a binaural representation of said first signal, said binaural representation consisting of first and second binaurally correlated signals which localize a binaural sonic image at a desired location; and crosstalk cancellation circuit means receptive of said first and second binaurally correlated signals for developing third and fourth binaurally correlated signals for application to said loudspeakers without producing the effect of acoustic crosstalk which might be preceptible by said listener if said first and second binaurally correlated signals were supplied directly to said loudspeakers.

2. Apparatus as claimed in claim 1, wherein said localization circuit means comprises:

means receptive of said first sound source signal and having a frequency characteristic determined in relation to the location of said sonic image to develop said first binaurally correlated signal; and means receptive of said first binaurally correlated signal and having a frequency response characteristic representing the difference in intensity and propagation time over the frequency range of said first binaurally correlated signal between a first and a second hypothetical acoustic signal which would be received at respective ears of said listener from said localized sonic image if he were seated with respect thereto, to thereby develop said second binaurally correlated signal.

3. Apparatus as claimed in claim 2, wherein said crosstalk cancellation circuit means comprises:

first and second subtractors each having positive and negative input terminals and an output terminal, the positive input terminal of the first subtractor being receptive of said first binaurally correlated signal, the positive input terminal of said second subtractor being receptive of said second binaurally correlated signal;

first and second filter-and-delay networks each having a transfer characteristic B/A wherein A represents a transmission characteristic over an acoustic path between a said loudspeaker and a said listener's ear nearer to said loudspeaker and B represents a transmission characteristic over an acoustic path between said loudspeaker and the listener's other ear, the first filter-and-delay network being receptive of said first binaurally correlated signal for application of its output signal to the negative input terminal of said first subtractor; and third and fourth filter-and-delay networks each having a transfer characteristic represented by $$\frac{1/A}{1-(B/A)^2},$$

the third filter-and-delay network being receptive of the output signal from the first subtractor and the fourth filter-and-delay network being receptive of the output signal from the second subtractor, the output signals from the third and fourth filter-and-delay networks being said third and fourth binaurally correlated signals.

4. A stereophonic sound reproduction system as claimed in claim 1, wherein said first signal converter comprises:

first and second input terminals receptive of first and second binaural signals, respectively;

first and second adders each having first and second inputs, the first input of the first and second adders being connected to said first and second input terminals, respectively;

first and second comparators each having an inverting and a noninverting input, the inverting input of the first and second comparators being connected to said first and second input terminals, respectively;

first and second filter-and-delay networks each having a transfer characteristic $Bi/Ai$, where $Ai$ represents a transmission characteristic over an acoustic path between a hypothetical electroacoustic transducer and one ear of the listener and $Bi$ represents a transmission characteristic over an acoustic path between and hypothetical electroacoustic transducer and the opposite ear of said listener, the first filter-and-delay network being connected between the output of said first comparator and the second input of said first adder, and the second filter-and-delay network being connected between the output of said second comparator and the second input of said second adder, the output of said first adder being connected to the noninverting input of the second comparator and the output of said second adder being connected to the noninverting input of the first comparator, wherein said second signal converter comprises:

first and second adders each having first and second inputs, the first input of the first and second adders being connected to the output of said first and second adders of the first signal converter, respectively;

first and second comparators each having an inverting and a noninverting input, the noninverting input of the first and second comparators being connected to the output of said first and second adders of said first signal converter, respectively;

first and second filter-and-delay networks each having a transfer characteristic B/A, where A represents a transmission characteristic over an acoustic path between an electroacoustic transducer actually located in said listening area and said one ear of said listener, and B represents a transmission characteristic over an acoustic path between said actually located electroacoustic transducer and the opposite ear of said listener, the first filter-and-delay network being connected between the output of said first comparator of the second signal converter and the second input of said first adder of the second signal converter, and the second filter-and-delay network being connected between the output of said second comparator of said second signal converter and the second input of said second adder of said second signal converter, the output of said first adder of said second signal converter being connected to the inverting input of said second comparator of said second signal converter, and the output of said second adder of said second signal converter being connected to the inverting input of said first comparator of said second signal converter; and first and second output terminals connected to the output of said first and second adders of the second signal converter, respectively.

5. Apparatus adapted to receive stereophonic signals for deriving signals to be applied to a multi-channel sterophony using loudspeakers in spaced relation with respect to a listener to give him a sense of an expanded stage width, comprising:

first and second filter-and-delay networks receptive of said stereophonic signals over separate channels and each having a transfer characteristic $A_i/A$ wherein A represents a transmission characteristic over an acoustic path between a said loudspeaker and a said listener'r ear nearer to said loudspeaker, and $A_i$ represents a transmission characteristic over an acoustic path between said listener's ear and a hypothetical sound reproduction source located at one end of said stage width nearer to said listener's ear;

third and fourth filter-and-delay networks connected respectively to the outputs of said first and second filter-and-delay networks, each having a transfer characteristic $(B_i/A_i)$ (A/B), wherein B represents a transmission characteristic over an acoustic path between a said loudspeaker and the listener's other ear, and $B_i$ represents a transmission characteristic over an acoustic path between said hypothetical sound reproduction source and said listener's the other ear;

first and second adders each having first and second input terminals and an output terminal, the first input terminal of the first adder being receptive of the output from said first filter-and-delay network and the first input terminal of the second adder being receptive of the output from said second filter-and-delay network;

first and second subtractors each having positive and negative input terminals and an output terminal, the positive input terminal of the first subtractor being connected to receive the output from said third filter-and-delay network and the positive input terminal of the second subtractor being connected to receive the output from said fourth filter-and-delay network; and fifth and sixth filter-and-delay networks each having a transfer chacteristic B/A, the fifth filter-and-delay network being connected between the output of said first subtractor and the second input terminal of the second adder, and the sixth filter-and-delay network being connected between the output of said second subtractor and the second input terminal of said first adder, the output of said first adder being connected to the negative input terminal of said first subtractor and the output of said second adder being connected to the negative input terminal of said second subtractor, the outputs of said first and second adders being the signals for said multichannel sterephony.

6. Apparatus as claimed in claim 5, further comprising a pair of ganged first and second variable attenuators, the first attenuator being interconnected between an output of said first adder and a negative input terminal of said first subtractor and the second attenuator being interconnected between the output of said second adder and the negative input terminal of said second subtractor.

7. Apparatus adapted to receive first and second stereophonic signals for deriving signals to be applied to a multi-channel sterophony using loudspeakers in spaced relation with respect to a listener to give him a sense of an expanded stage width, comprising:

first and second adders each having first and second input terminals and an output terminal, the first input terminals of the first and second adders being separately receptive of said first and second stereophonic signals;

first and second subtractors each having positive and negative input terminals and an output terminal:

a pair of ganged first and second variable attenuators, the first attenuator being connected between said first input terminal of said first adder and the positive input terminal of the first subtractor, the second attenuator being connected between said second input terminal of said second adder and the positive input terminal of said second subtractor;

first and second filter-and-delay networks each having a transfer characteristic B/A wherein A represents a transmission characteristic over an acoustic path between a said loudspeaker and a said listener's ear nearer to said loudspeaker, and B represents a transmission characteristic over an acoustic path between said loudspeaker and the listener's other ear, the first filter-and-delay network being connected between the output of said first subtractor and the second input of said second adder, and the second filter-and-delay network being connected between the output of said second subtractor and the second input of said first adder; and a pair of ganged third and fourth variable attenuators, the third attenuator being connected between the output of said first adder and the negative input terminal of said first subtractor, and the fourth attenuator being connected between the output of said second adder and the negative input terminal of said second subtractor, the outputs of said first and second adders being the signals for said multichannel sterophony.

8. Apparatus adapted to receive sterophonic signals for deriving signals to be applied to a multi-channel stereophony using loudspeakers in spaced relation with respect to a listener to give him a sense of an expanded stage with, comprising:

localization circuit means receptive of said stereophonic signals for developing a binaural representation of said stereophonic signals, said binaural representation consisting of first and second binaurally correlated signals which localize a binaural sonic image at a desired location in said stage width; and crosstalk cancellation circuit means receptive of said first and second binaurally correlated signals for developing third and fourth binaurally correlated signals for application to said loudspeakers without producing the effect of acoustic crosstalks which might be perceptible by said listener if said first and second binaurally correlated signals were separately supplied directly to said loudspeakers.

9. Apparatus as claimed in claim 8, wherein said localization circuit means comprises:

first and second filter-and-delay networks respectively receptive of said sterophonic signals, each of said first and second filter-and-delay networks having a transfer characteristic $A_i$ which represents a transmission characteristic over an acoustic path between a hypotherical sound reproduction source in said desired location and a listener's ear nearer to said hypothetical sound reproduction source;

first and second adders each having first and second input terminals, the first input terminals of said first and second adders being connected to the outputs of said first and second filter-and-delay networks, respectively; and third and fourth filter-and-delay networks each having a transfer characteristic $B_i/A_i$, wherein $B_i$ represents a transmission characteristic over an acoustic path between said hypothetical sound reproduction source and said listener's other ear, the third filter-and-delay network being connected between the output of said second filter-and-delay network and the second input terminal of said first adder, the fourth filter-and-delay network being connected between the output of said filter-and-delay network and the second input terminal of said second adder, and wherein said crosstalk cancellation circuit means comprises:

fifth and sixth filter-and-delay networks each having a transfer characteristic T/A, wherein A represents a transmission characteristic over an acoustic path between said listener's ear and a said loudspeaker nearer to said listener's ear, and T represents a delay time, said fifth and sixth filter-and-delay networks being receptive of the outputs of said first and second adders, respectively;

first and second subtractors each having positive and negative input terminals and an output terminal, the positive inputs terminals of the first and second subtractors being connected to the outputs of said fifth and sixth filter-and-delay networks, respectively;

seventh and eighth filter-and-delay networks each having a transfer characteristic B/A, wherein B represents a transmission characteristic over an acoustic path between said loudspeaker and said listener's other ear, the seventh filter-and-delay network being connected between the output of said second subtractor and the negative input terminal of said first subtractor and the eighth filter-and-delay network being connected between the output of said first subtractor and the negative input terminal of said second subtractor, the outputs of said first and second subtractor being the signals for said multi-channel stereophony.

10. Apparatus as claimed in claim 9, further comprising ninth and tenth filter-and-delay networks each having a transfer characteristic $(A+B)/(A_i+B_i)$, the ninth and tenth filter-and-delay networks being connected to the outputs of said first and second subtractors, respectively.

11. Apparatus as claimed in claim 8, wherein said localization circuit means comprises:

first and second adders each having first and second input terminals, the first input terminals of the first and second adders being connected to receive said stereophonic signals, respectively;

first and second subtractors each having positive and negative input terminal and an output terminal, the negative input terminals of the first and second subtractors being connected to the second input terminals of said first and second adders, respectively;

first and second filter-and-delay networks each having a transfer characteristic $B_i/A_i$, wherein $A_i$ represents a transmission characteristic over an acoustic path between a hypothetical sound reproduction source and a said listener's ear nearer thereto, and $B_i$ represents a transmission characteristic over an acoustic path between said hypothetical reproduction source and said listener's other ear, the first filter-and-delay network being connected between the output of said first subtractor and the second input of said first adder, the second filter-and-delay network being connected between the output of said second subtractor and the second input of said second adder, the output of said first adder being connected to the positive input terminal of the second subtractor, the output of said second adder being connected to the positive input terminal of the first subtractor, and wherein said crosstalk cancellation circuit means comprises:

third and fourth adders each having first and second inputs terminals and an output terminal, the first input terminals of the third and fourth adders being connected to the output terminal of said first and second adders of the localization circuit means, respectively;

third and fourth subtractors each having positive and negative input terminals and an output terminal, the positive input terminals of the third and fourth subtractors being connected to the outputs of said first and second adders of the localization circuit means, respectively, the output of said third adder being connected to the negative input terminal of the fourth subtractor, the output of said fourth adder being connected to the negative input terminal of the third subtractor;

third and fourth filter-and-delay networks each having a transfer characteristic B/A, wherein A represents a transmission characteristic over an acoustic path between a said listener's ear and a said loudspeaker nearer thereto, and B represents a transmission characteristic over an acoustic path between said loudspeaker and said listener's other ear, the third filter-and-delay network being connected between the output of said third subtractor and the second input of said third adder, the fourth filter-and-delay network being connected between the output of said fourth subtractor and the second input of said fourth adder, the outputs from said third and fourth adders being said third and fourth binaurally correlated signals.

12. A quadraphonic signal processing system comprising:

a pair of front-right and front-left output terminals for connection to a pair of front-right and front-left loudspeakers respectively which are disposed a predetermined equal distance from each other in front of a listener;

a pair of rear-right and rear-left output terminals for connection to a pair of rear-right and rear-left loudspeakers respectively which are disposed a predetermined equal distance from each other at the rear end of the listener;

first signal converter means receptive of an audio input signal for converting the same into a pair of binaural signals which carry information as to the localization of a binaural sonic image at a desired location, said converter means including first filter means receptive of said audio input signal for converting the same into a first signal and having a frequency response characteristic determined by the location of said sonic image, and second filter means receptive of said first signal for converting the same into a second signal and having a frequency response characteristic which represents the difference in intensity and propagation time over the frequency range of said first signal between a first and a second acoustic signal which would be received at respective ears of the listener seated with respect to said sonic image;

second signal converter means having right- and left-channel input terminals receptive of said first and second signals from the first signal converter means respectively for converting said first and second signals into front-right and front-left signals which, when reproduced by said front-right and front-left loudspeakers, will produce no acoustic crosstalks at the listener's ears;

third signal converter means having right- and left-channel input terminals receptive of said first and second signals from said first signal converter means respectively for converting said first and second signals into rear-right and rear-left signals which, when reproduced by said rear-right and rear-left loudspeakers, will produce no acoustic crosstalks at the listener's ears; and means for delivering said front-right and front-left signals from the second signals converter means and said rear-right and rear-left signals from the third signal converter means to said front-right and front-left output terminals and said rear-right and rear-left output terminals, respectively.

13. A quadraphonic signal processing system as claimed in claim 12, further comprising:

a pair of ganged first and second variable attenuators, the first attenuator being interposed in the circuit connecting the first signal from said first signal converter means to the right channel input terminal of said second signal converter means, and the second attenuator being interposed in the circuit connecting the second signal from said first signal converter means to the left channel input terminal of said second signal converter means; and a pair of ganged third and fourth variable attenuators, the third attenuator being interposed in the circuit connecting the first signal from said first signal converter means to the right channel input terminal of said third signal converter means, and the fourth attenuator being interposed in the circuit connecting the second signal from said first signal converter means to the left channel input terminal of said third signal converter means.

* * * * *